US008069916B2

(12) United States Patent
Giroux et al.

(10) Patent No.: US 8,069,916 B2
(45) Date of Patent: Dec. 6, 2011

(54) SYSTEM AND METHODS FOR TUBULAR EXPANSION

(75) Inventors: Richard Lee Giroux, Cypress, TX (US); Mike A. Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 118 days.

(21) Appl. No.: 11/962,290

(22) Filed: Dec. 21, 2007

(65) Prior Publication Data

US 2008/0156499 A1 Jul. 3, 2008

Related U.S. Application Data

(60) Provisional application No. 60/883,254, filed on Jan. 3, 2007.

(51) Int. Cl.
*E21B 23/04* (2006.01)

(52) U.S. Cl. ..... 166/212; 166/383

(58) Field of Classification Search ..... 166/207, 166/380, 212, 383, 384
See application file for complete search history.

(56) References Cited

U.S. PATENT DOCUMENTS

| | | | |
|---|---|---|---|
| 3,203,451 | A | 8/1965 | Vincent |
| 3,203,483 | A | 8/1965 | Vincent |
| 3,712,376 | A | 1/1973 | Owen et al. |
| 3,746,092 | A | 7/1973 | Land |
| 3,785,193 | A | 1/1974 | Kinley et al. |
| 3,934,836 | A | 1/1976 | Dunlap et al. |
| 3,940,227 | A | 2/1976 | Strasser |
| 4,070,941 | A | 1/1978 | Lorenz |
| 4,210,991 | A | 7/1980 | Cooper, Jr. |
| 4,212,186 | A | 7/1980 | Blattler |
| 4,415,029 | A | 11/1983 | Pratt et al. |
| 4,712,615 | A | 12/1987 | Dockins, Jr. et al. |
| 4,754,543 | A | 7/1988 | Spivy |
| 5,070,940 | A | 12/1991 | Conner et al. |
| 5,112,158 | A | 5/1992 | McConnell |
| 5,264,162 | A | 11/1993 | Salem et al. |
| 5,327,765 | A | 7/1994 | Weykamp et al. |
| 5,366,012 | A | 11/1994 | Lohbeck |

(Continued)

FOREIGN PATENT DOCUMENTS

WO WO 02/086285 10/2002

(Continued)

OTHER PUBLICATIONS

EP Search Report, Application No. EP 08150002, dated May 23, 2008.

(Continued)

*Primary Examiner* — William P Neuder
*Assistant Examiner* — Blake Michener
(74) *Attorney, Agent, or Firm* — Patterson & Sheridan, LLP

(57) ABSTRACT

Methods and apparatus enable expanding tubing in a borehole of a hydrocarbon well. According to some embodiments, an expander device includes a collapsible swage formed of collets, at least one slip arrangement and a hydraulic jack to stroke the swage through tubing to be expanded. In operation, expanding tubing may include securing an expansion tool to the tubing, lowering the tool and tubing into a borehole, actuating a collapsible expander of the expansion tool to an extended configuration, and supplying fluid pressure to a jack coupled to the expander thereby moving the expander through the tubing which is held by at least one of first and second tubing holding devices disposed respectively ahead of the expander and behind the expander.

35 Claims, 10 Drawing Sheets

U.S. PATENT DOCUMENTS

| | | | | |
|---|---|---|---|---|
| 5,392,626 | A | 2/1995 | Blezard et al. | |
| 5,433,275 | A * | 7/1995 | Melenyzer et al. | 166/380 |
| 5,479,699 | A | 1/1996 | Snyder | |
| 5,640,879 | A | 6/1997 | Damsohn et al. | |
| 5,667,011 | A | 9/1997 | Gill et al. | |
| 5,746,557 | A | 5/1998 | Kaibach | |
| 5,752,311 | A | 5/1998 | Snyder | |
| 5,785,120 | A | 7/1998 | Smalley et al. | |
| 5,823,031 | A | 10/1998 | Campbell et al. | |
| 5,887,476 | A | 3/1999 | Damsohn et al. | |
| 5,901,789 | A | 5/1999 | Donnelly et al. | |
| 5,924,745 | A | 7/1999 | Campbell | |
| 6,012,523 | A | 1/2000 | Campbell et al. | |
| 6,021,850 | A | 2/2000 | Wood et al. | |
| 6,029,748 | A | 2/2000 | Forsyth et al. | |
| 6,065,500 | A | 5/2000 | Metcalfe | |
| 6,098,717 | A | 8/2000 | Bailey et al. | |
| 6,112,818 | A | 9/2000 | Campbell | |
| 6,142,230 | A | 11/2000 | Smalley et al. | |
| 6,189,631 | B1 | 2/2001 | Sheshtawy | |
| 6,322,109 | B1 | 11/2001 | Campbell et al. | |
| 6,325,148 | B1 | 12/2001 | Trahan et al. | |
| 6,334,351 | B1 | 1/2002 | Tsuchiya | |
| 6,352,148 | B1 | 3/2002 | Hindemith | |
| 6,425,444 | B1 | 7/2002 | Metcalfe et al. | |
| 6,454,007 | B1 | 9/2002 | Bailey | |
| 6,454,013 | B1 | 9/2002 | Metcalfe | |
| 6,457,532 | B1 | 10/2002 | Simpson | |
| 6,457,533 | B1 | 10/2002 | Metcalfe | |
| 6,460,616 | B1 | 10/2002 | Simpson | |
| 6,478,092 | B2 | 11/2002 | Voll et al. | |
| 6,510,896 | B2 | 1/2003 | Bode et al. | |
| 6,513,588 | B1 | 2/2003 | Metcalfe | |
| 6,527,049 | B2 | 3/2003 | Metcalfe et al. | |
| 6,536,525 | B1 | 3/2003 | Haugen et al. | |
| 6,543,552 | B1 * | 4/2003 | Metcalfe et al. | 175/57 |
| 6,550,539 | B2 | 4/2003 | Maguire et al. | |
| 6,571,672 | B1 | 6/2003 | Rudd | |
| 6,571,871 | B2 | 6/2003 | Lauritzen et al. | |
| 6,578,630 | B2 | 6/2003 | Simpson et al. | |
| 6,585,053 | B2 | 7/2003 | Coon | |
| 6,591,905 | B2 | 7/2003 | Coon | |
| 6,598,678 | B1 | 7/2003 | Simpson et al. | |
| 6,622,789 | B1 * | 9/2003 | Braddick | 166/277 |
| 6,629,567 | B2 | 10/2003 | Lauritzen et al. | |
| 6,648,075 | B2 | 11/2003 | Badrak et al. | |
| 6,662,876 | B2 | 12/2003 | Lauritzen | |
| 6,668,930 | B2 | 12/2003 | Hoffman | |
| 6,685,236 | B2 | 2/2004 | Setterberg, Jr. | |
| 6,688,395 | B2 | 2/2004 | Maguire et al. | |
| 6,688,399 | B2 | 2/2004 | Maguire et al. | |
| 6,688,400 | B2 | 2/2004 | Metcalfe et al. | |
| 6,691,789 | B2 | 2/2004 | Jackson et al. | |
| 6,695,063 | B2 | 2/2004 | Lauritzen et al. | |
| 6,695,065 | B2 | 2/2004 | Simpson et al. | |
| 6,698,517 | B2 | 3/2004 | Simpson et al. | |
| 6,702,029 | B2 | 3/2004 | Metcalfe et al. | |
| 6,702,030 | B2 | 3/2004 | Simpson et al. | |
| 6,708,762 | B2 | 3/2004 | Haugen et al. | |
| 6,708,767 | B2 | 3/2004 | Harrall et al. | |
| 6,708,769 | B2 | 3/2004 | Haugen et al. | |
| 6,712,142 | B2 | 3/2004 | Simpson et al. | |
| 6,712,151 | B2 | 3/2004 | Simpson et al. | |
| 6,722,427 | B2 | 4/2004 | Gano et al. | |
| 6,722,441 | B2 | 4/2004 | Lauritzen et al. | |
| 6,722,442 | B2 | 4/2004 | Simpson | |
| 6,722,443 | B1 | 4/2004 | Metcalfe | |
| 6,725,917 | B2 | 4/2004 | Metcalfe | |
| 6,732,806 | B2 | 5/2004 | Mauldin et al. | |
| 6,742,591 | B2 | 6/2004 | Metcalfe | |
| 6,742,598 | B2 | 6/2004 | Whitelaw et al. | |
| 6,742,606 | B2 | 6/2004 | Metcalfe et al. | |
| 6,745,839 | B1 | 6/2004 | Simpson | |
| 6,745,841 | B2 | 6/2004 | Simpson | |
| 6,745,846 | B1 | 6/2004 | Innes et al. | |
| 6,752,215 | B2 | 6/2004 | Maguire et al. | |
| 6,752,216 | B2 | 6/2004 | Coon | |
| 6,758,275 | B2 | 7/2004 | Martin | |
| 6,782,953 | B2 | 8/2004 | Maguire et al. | |
| 6,789,622 | B1 | 9/2004 | Ducasse et al. | |
| 6,805,196 | B2 | 10/2004 | Lawrence | |
| 6,820,687 | B2 | 11/2004 | Maguire et al. | |
| 6,832,649 | B2 | 12/2004 | Bode et al. | |
| 6,834,725 | B2 | 12/2004 | Whanger et al. | |
| 6,840,325 | B2 | 1/2005 | Stephenson | |
| 6,843,319 | B2 | 1/2005 | Tran et al. | |
| 6,845,820 | B1 | 1/2005 | Hebert et al. | |
| 6,851,475 | B2 | 2/2005 | Simpson et al. | |
| 6,860,329 | B1 | 3/2005 | Oosterling | |
| 6,866,100 | B2 | 3/2005 | Gudmestad et al. | |
| 6,868,905 | B2 | 3/2005 | Lauritzen et al. | |
| 6,877,553 | B2 | 4/2005 | Cameron | |
| 6,896,052 | B2 | 5/2005 | Simpson et al. | |
| 6,896,057 | B2 | 5/2005 | Metcalfe | |
| 6,899,181 | B2 | 5/2005 | Simpson et al. | |
| 6,902,000 | B2 | 6/2005 | Simpson et al. | |
| 6,907,937 | B2 | 6/2005 | Whanger et al. | |
| 6,910,388 | B2 | 6/2005 | Jones | |
| 6,920,932 | B2 | 7/2005 | Zimmerman | |
| 6,920,934 | B2 | 7/2005 | Badrak et al. | |
| 6,920,935 | B2 | 7/2005 | Metcalfe | |
| 6,923,261 | B2 | 8/2005 | Metcalfe et al. | |
| 6,932,161 | B2 | 8/2005 | Cameron | |
| 6,935,429 | B2 | 8/2005 | Badrak | |
| 6,935,430 | B2 | 8/2005 | Harrall et al. | |
| 6,938,694 | B2 | 9/2005 | Rudd | |
| 6,942,029 | B2 | 9/2005 | Simpson | |
| 6,942,036 | B2 * | 9/2005 | Gabrysch et al. | 166/312 |
| 6,953,086 | B2 | 10/2005 | Simpson | |
| 6,953,096 | B2 | 10/2005 | Gledhill et al. | |
| 6,966,369 | B2 | 11/2005 | Harrall et al. | |
| 6,968,896 | B2 | 11/2005 | Coon | |
| 6,976,536 | B2 | 12/2005 | Simpson et al. | |
| 6,976,539 | B2 | 12/2005 | Metcalfe et al. | |
| 6,981,547 | B2 | 1/2006 | Maguire et al. | |
| 6,988,557 | B2 | 1/2006 | Whanger et al. | |
| 6,991,040 | B2 | 1/2006 | Hill, Jr. et al. | |
| 6,997,264 | B2 | 2/2006 | Simpson et al. | |
| 6,997,266 | B2 | 2/2006 | Jackson et al. | |
| 7,004,257 | B2 | 2/2006 | Simpson et al. | |
| 7,004,264 | B2 | 2/2006 | Simpson et al. | |
| 7,011,162 | B2 | 3/2006 | Maguire | |
| 7,017,669 | B2 | 3/2006 | Johnston et al. | |
| 7,025,135 | B2 | 4/2006 | Ellington et al. | |
| 7,028,770 | B2 | 4/2006 | Smith, Jr. et al. | |
| 7,028,780 | B2 | 4/2006 | Maguire | |
| 7,032,679 | B2 | 4/2006 | Maguire et al. | |
| 7,048,050 | B2 | 5/2006 | Vail, III et al. | |
| 7,048,063 | B2 | 5/2006 | Cameron | |
| 7,048,065 | B2 | 5/2006 | Badrak et al. | |
| 7,051,587 | B2 | 5/2006 | Simpson et al. | |
| 7,055,597 | B2 | 6/2006 | Lauritzen | |
| 7,063,143 | B2 | 6/2006 | Tilton et al. | |
| 7,063,149 | B2 | 6/2006 | Simpson et al. | |
| 7,066,259 | B2 | 6/2006 | Duggan et al. | |
| 7,070,001 | B2 | 7/2006 | Whanger et al. | |
| 7,073,601 | B2 | 7/2006 | Cameron | |
| 7,073,602 | B2 | 7/2006 | Simpson et al. | |
| 7,077,196 | B2 | 7/2006 | Rudd | |
| 7,077,197 | B2 | 7/2006 | Harrall | |
| 7,077,210 | B2 | 7/2006 | MacKay et al. | |
| 7,086,477 | B2 * | 8/2006 | Duggan | 166/380 |
| 7,086,478 | B2 | 8/2006 | Simpson et al. | |
| 7,086,480 | B2 | 8/2006 | Simpson et al. | |
| 7,090,005 | B2 | 8/2006 | Smith, Jr. et al. | |
| 7,090,024 | B2 | 8/2006 | Simpson et al. | |
| 7,090,025 | B2 | 8/2006 | Haugen et al. | |
| 7,096,570 | B2 | 8/2006 | Marr et al. | |
| 7,100,713 | B2 | 9/2006 | Tulloch | |
| 7,104,322 | B2 | 9/2006 | Whanger et al. | |
| 7,107,663 | B2 | 9/2006 | Ellington et al. | |
| 7,114,559 | B2 * | 10/2006 | Sonnier et al. | 166/206 |
| 7,117,957 | B2 | 10/2006 | Metcalfe et al. | |
| 7,121,337 | B2 * | 10/2006 | Cook et al. | 166/207 |
| 7,121,351 | B2 | 10/2006 | Luke et al. | |
| 7,124,821 | B2 | 10/2006 | Metcalfe et al. | |
| 7,124,826 | B2 | 10/2006 | Simpson | |

| | | | | |
|---|---|---|---|---|
| 7,124,830 | B2 | 10/2006 | Metcalfe | |
| 7,131,504 | B2 | 11/2006 | Odell, II et al. | |
| 7,140,442 | B2 | 11/2006 | Mackay et al. | |
| 7,140,446 | B2 | 11/2006 | Metcalfe | |
| 7,144,243 | B2 | 12/2006 | Stephenson et al. | |
| 7,152,679 | B2 | 12/2006 | Simpson | |
| 7,152,684 | B2 | 12/2006 | Harrall et al. | |
| 7,156,179 | B2 | 1/2007 | Harrall et al. | |
| 7,163,057 | B2 | 1/2007 | Hebert et al. | |
| 7,168,497 | B2 | 1/2007 | Metcalfe et al. | |
| 7,168,606 | B2 | 1/2007 | Badrak | |
| 7,172,027 | B2 | 2/2007 | Simpson et al. | |
| 7,174,764 | B2 | 2/2007 | Oosterling et al. | |
| 7,182,141 | B2 | 2/2007 | Tran et al. | |
| 7,185,701 | B2 | 3/2007 | Mackenzie | |
| 7,204,314 | B2 | 4/2007 | Lauritzen et al. | |
| 7,234,532 | B2 | 6/2007 | Metcalfe et al. | |
| 7,255,171 | B2 | 8/2007 | Rudd | |
| 7,255,177 | B2 * | 8/2007 | Duggan et al. | 166/380 |
| 7,267,175 | B2 | 9/2007 | Haugen et al. | |
| 7,275,601 | B2 | 10/2007 | Cook et al. | |
| 7,275,602 | B2 | 10/2007 | Green et al. | |
| 7,287,603 | B2 * | 10/2007 | Hay et al. | 175/57 |
| 7,293,616 | B2 | 11/2007 | Tulloch | |
| 7,308,944 | B2 | 12/2007 | Johnston et al. | |
| 7,322,420 | B2 | 1/2008 | Trinder et al. | |
| 7,325,618 | B2 | 2/2008 | Simpson et al. | |
| 7,350,584 | B2 | 4/2008 | Simpson et al. | |
| 7,350,585 | B2 | 4/2008 | Simpson et al. | |
| 7,350,588 | B2 | 4/2008 | Abercrombie Simpson et al. | |
| 7,357,189 | B2 | 4/2008 | Aldaz et al. | |
| 7,367,389 | B2 | 5/2008 | Duggan et al. | |
| 7,367,404 | B2 | 5/2008 | Simpson et al. | |
| 7,370,708 | B2 | 5/2008 | Simpson et al. | |
| 7,373,990 | B2 | 5/2008 | Harrall et al. | |
| 7,377,325 | B2 | 5/2008 | Trinder et al. | |
| 7,380,839 | B2 | 6/2008 | Ellington et al. | |
| 7,398,832 | B2 * | 7/2008 | Brisco | 166/380 |
| 7,401,650 | B2 | 7/2008 | MacKenzie | |
| 7,410,001 | B2 | 8/2008 | Harrall et al. | |
| 7,416,027 | B2 * | 8/2008 | Ring et al. | 166/380 |
| 7,419,193 | B2 | 9/2008 | Simpson | |
| 7,438,133 | B2 * | 10/2008 | Brisco | 166/380 |
| 7,513,313 | B2 * | 4/2009 | Watson et al. | 166/380 |
| 7,575,060 | B2 | 8/2009 | Hillis et al. | |
| 7,597,140 | B2 * | 10/2009 | Filippov et al. | 166/207 |
| 7,757,774 | B2 | 7/2010 | Ring | |
| 2002/0007950 | A1 | 1/2002 | Simpson et al. | |
| 2002/0040788 | A1 | 4/2002 | Hill, Jr. et al. | |
| 2002/0162596 | A1 | 11/2002 | Simpson | |
| 2002/0175474 | A1 | 11/2002 | Simpson et al. | |
| 2003/0042022 | A1 | 3/2003 | Lauritzen et al. | |
| 2003/0042028 | A1 | 3/2003 | Lauritzen et al. | |
| 2003/0075337 | A1 | 4/2003 | Maguire | |
| 2003/0075340 | A1 | 4/2003 | Tran et al. | |
| 2003/0168222 | A1 | 9/2003 | Maguire et al. | |
| 2004/0017081 | A1 | 1/2004 | Simpson et al. | |
| 2004/0055786 | A1 | 3/2004 | Maguire et al. | |
| 2004/0118571 | A1 | 6/2004 | Lauritzen et al. | |
| 2004/0129431 | A1 | 7/2004 | Jackson | |
| 2004/0140086 | A1 | 7/2004 | Tran et al. | |
| 2004/0145184 | A1 | 7/2004 | Setterberg, Jr. | |
| 2004/0149442 | A1 | 8/2004 | Mackenzie | |
| 2004/0159466 | A1 | 8/2004 | Haugen et al. | |
| 2004/0173360 | A1 | 9/2004 | Harrall et al. | |
| 2004/0216506 | A1 | 11/2004 | Simpson et al. | |
| 2004/0216878 | A1 * | 11/2004 | Metcalfe et al. | 166/285 |
| 2004/0231843 | A1 | 11/2004 | Simpson | |
| 2004/0251033 | A1 | 12/2004 | Cameron et al. | |
| 2004/0256098 | A1 | 12/2004 | Ducasse et al. | |
| 2005/0005668 | A1 | 1/2005 | Duggan et al. | |
| 2005/0022995 | A1 | 2/2005 | Martin et al. | |
| 2005/0029812 | A1 | 2/2005 | Metcalfe | |
| 2005/0056433 | A1 * | 3/2005 | Ring et al. | 166/384 |
| 2005/0056434 | A1 | 3/2005 | Watson et al. | |
| 2005/0103502 | A1 | 5/2005 | Watson et al. | |
| 2005/0127671 | A1 | 6/2005 | Ellington et al. | |
| 2005/0161213 | A1 | 7/2005 | Sonnier et al. | |
| 2005/0184521 | A1 | 8/2005 | Maguire | |
| 2005/0229342 | A1 | 10/2005 | Simpson et al. | |
| 2006/0243444 | A1 * | 11/2006 | Brisco et al. | 166/298 |
| 2007/0187113 | A1 * | 8/2007 | Hester | 166/380 |
| 2007/0240878 | A1 * | 10/2007 | Filippov et al. | 166/207 |

FOREIGN PATENT DOCUMENTS

| | | | |
|---|---|---|---|
| WO | WO 03/029609 | | 4/2003 |
| WO | WO 2004/094766 | | 4/2004 |
| WO | WO 2004027200 | A2 * | 4/2004 |
| WO | WO 2004/099561 | | 11/2004 |
| WO | WO 2005/052304 | | 9/2005 |

OTHER PUBLICATIONS

Prosecution History for U.S. Appl. No. 12/177,731 from Jul. 22, 2008—Aug. 27, 2009 including the following: Search Report dated Aug. 16, 2002 Response to Office Action dated Feb. 12, 2009 Office Action dated Feb. 12, 2009 Preliminary Amendment dated Aug. 28, 2008.

Canadian Office Action for Canadian Application No. 2,616,055 dated Sep. 15, 2009.

Mike Bullock, Tom Grant, Rick Sizemore, Chan Daigle and Pat York, Enventure Global Technology LLC, "Using Expandable Solid Tubulars to Solve Well Construction Challenges in Deep Waters and Maturing Properties," IBP 275 00, Rio Oil & Gas Expo and Conference, Oct. 16-19, 2000, Rio de Janeiro, Brazil, pp. 1-14.

Kenneth K. Dupal, Shell Deepwater Development, Inc.; Donald B. Campo, Shell Exploration & Production Technology; John E. Lofton, Chevron Petroleum Technology Company; Don Weisinger, BP; R. Lance Cook, Michael D. Bullock, Thomas P. Grant and Patrick L. York, Enventure Global Technology, L.L.C., "Solid Expandable Tubular Technology—A Year of Case Histories in the Drilling Environment," SPE/IADC 67770, SPE/IADC Drilling Conference, Amsterdam, The Netherlands, Feb. 27-Mar. 1, 2001, pp. 1-16.

Chan L. Daigle, SPE, Enventure Global Technology; Donald B. Campo, SPE, Shell Exploration & Production Company; Carey J. Naquin, SPE, Halliburton Energy Services; Rudy Cardenas, Occidental Permian, Ltd.; Lev M. Ring, Patrick L. York, SPE, Enventure Global Technology, "Expandable Tubulars: Field Examples of Application in Well Construction and Remediation," SPE 62958, 2000 SPE Annual Technical Conference and Exhibition, Dallas, Texas, Oct. 1-4, 2000, pp. 1-14.

C. Lee Lohoefer and Ben Mathis, Unocal; David Brisco, Halliburton Energy Services; Kevin Waddell, Lev Ring, and Patrick York, Enventure Global Technology, "Expandable Liner Hanger Provides Cost-Effective Alternative Solution," IADC/SPE 59151, 2000 IADC/SPE Drilling Conference, New Orleans, Louisiana, Feb. 23-25, 2000, pp. 1-12.

Paul Metcalfe, Petroline Wireline Services Ltd., "Expandable Slotted Tubes Offer Well Design Benefits," Hart's Petroleum Engineer International, Oct. 1996, pp. 60-63.

"Expandable Sand Screen," Weatherford Completion Systems Brochure 160.02, © 2001 Weatherford, 24 pages.

Simon Harrall, "Expand Solid Tubular Expansion," STE Briefing No. 1, Mar. 2001, 4 pages.

"Expandable Technologies Sand Control," Weatherford Completion Systems Brochure 160.04, © 2002 Weatherford, 15 pages.

* cited by examiner

SYSTEM AND METHODS FOR TUBULAR EXPANSION

CROSS-REFERENCE TO RELATED APPLICATIONS

This application claims benefit of United States provisional patent application Ser. No. 60/883,254, filed Jan. 3, 2007, which is herein incorporated by reference.

BACKGROUND OF THE INVENTION

1. Field of the Invention

Embodiments of the invention generally relate to tubing expansion.

2. Description of the Related Art

Methods and apparatus utilized in the oil and gas industry enable placing tubular strings in a borehole and then expanding the circumference of the strings in order increase a fluid path through the tubing and in some cases to line the walls of the borehole. Some of the advantages of expanding tubing in a borehole include relative ease and lower expense of handling smaller diameter tubing and ability to mitigate or eliminate formation of a restriction caused by the tubing thereby enabling techniques that may create a monobore well. Many examples of downhole expansion of tubing exist including patents, such as U.S. Pat. No. 6,457,532, owned by the assignee of the present invention.

However, prior expansion techniques may not be possible or desirable in some applications. Further, issues that present problems with some of these approaches may include ease of makeup at the drill rig floor and operation, ability to transmit torque across an expander tool, and capability to recover a stuck expander tool or insert the tool through restrictions smaller than an expansion diameter. Carrying the expander tool in with unexpanded tubing and fixing the tubing relative to the expander tool can create additional challenges for some applications.

Therefore, there exists a need for improved methods and apparatus for expanding tubing.

SUMMARY OF THE INVENTION

A system for expanding tubing in one embodiment includes an expander disposed on a work string and having a first extended configuration capable of expanding the tubing and a second collapsed configuration with a smaller outer diameter than the first extended configuration. The system further includes first and second tubing holding devices disposed on the work string and located respectively ahead of the expander and behind the expander. Additionally, a hydraulic operated jack couples to the expander to move the expander relative to the tubing holding devices.

For one embodiment, a method of expanding tubing includes securing an expansion tool to the tubing, wherein the expansion tool includes an expander, a jack, and first and second tubing holding devices. The method further includes actuating the expander of the expansion tool to a first extended configuration from a second collapsed configuration having a smaller outer diameter than the first extended configuration. Supplying fluid pressure to the jack coupled to the expander thereby moves the expander through the tubing which is held by at least one of the first and second tubing holding devices disposed respectively ahead of the expander and behind the expander.

A method of expanding tubing in one embodiment includes providing an assembly with an expansion tool, the tubing, and a boring tool, wherein the expansion tool includes an expander, a jack, and first and second tubing holding devices. The method further includes running the assembly in a borehole, forming a borehole extension with the boring tool, and disposing the tubing at least partially within the borehole extension. In addition, supplying fluid pressure to the jack coupled to the expander thereby expands the tubing as the expander moves through the tubing which is held by at least one of the first and second tubing holding devices disposed respectively ahead of the expander and behind the expander.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
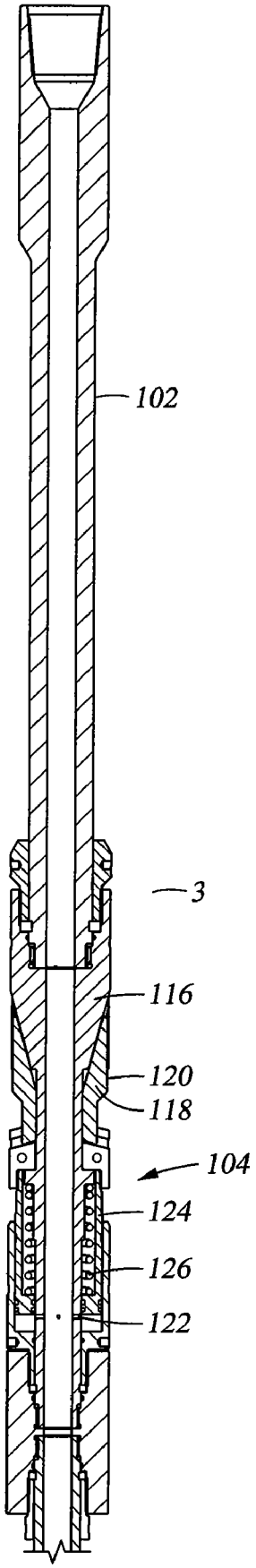
FIGS. 1A to 1G are a cross-section view of an expander tool in a deactivated configuration, according to embodiments of the invention.
Figure 1B:
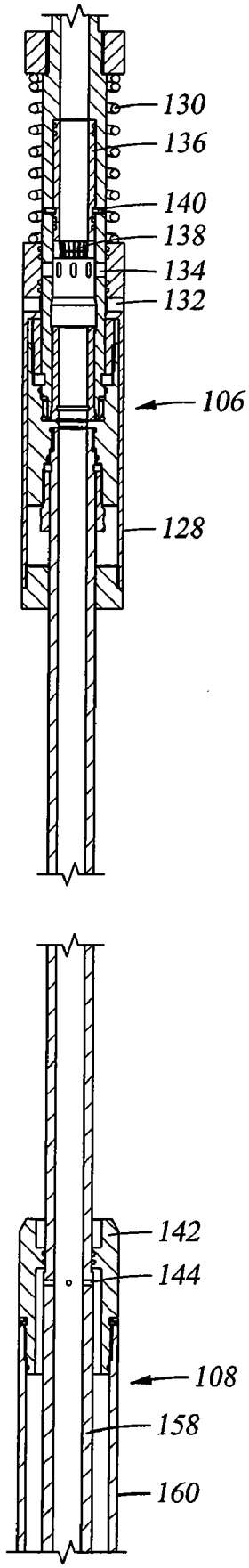

Embodiments of the invention generally relate to methods and assemblies suitable for expanding tubing in a borehole of a hydrocarbon well. According to some embodiments, an expander device includes a collapsible swage formed of collets, at least one slip arrangement and a hydraulic jack to stroke the swage through tubing to be expanded. The tubing may be any type of tubular member or pipe such as casing, liner, screen or open-hole clad. As an example of an application that may utilize embodiments of the invention, U.S. Provisional Patent Application No. 60/829,374, which is herein incorporated by reference, illustrates procedures where an open-hole clad is expanded in-situ in order to form a monobore well.

FIGS. 1A to 1G illustrate a cross-section view of an expander tool 400 (illustrated in its entirety schematically in FIG. 4) in a deactivated configuration. The expander tool 400 includes a pickup sub 102 and a first slip assembly 104 both shown in FIG. 1A, a tell tail assembly 106 shown in FIG. 1B, one or more jacks 108 shown in FIGS. 1B through 1E, an externally threaded, tool-to-unexpanded tubing, coupler sub 110 shown in FIG. 1F, and a collapsible expander or swage 112 and a second slip assembly 114 shown in FIG. 1G. These and other components of the expander tool 400 enable easy reconfiguration or replacement of one or more module components such as described further herein. For example, the pickup sub 102 may be interchanged to switch from one drill pipe or work string thread to another depending on a work string 404 (shown in FIG. 4) employed to convey the tool 400 into a borehole.

Figure 3:
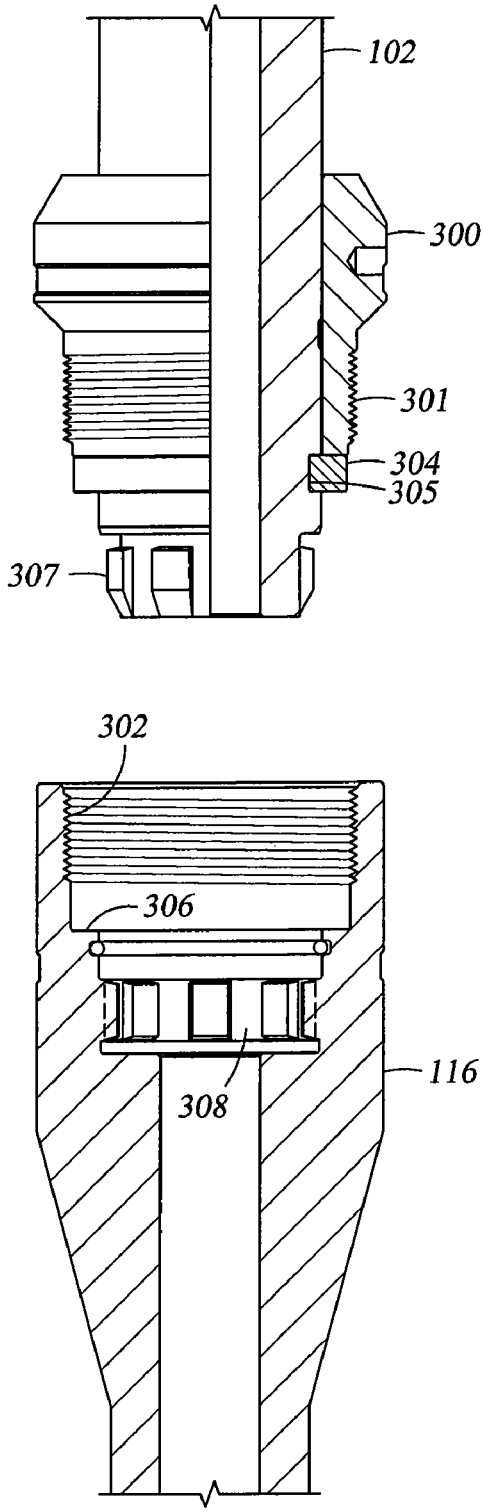
FIG. 3 is a partial cross-section and exploded view of a connection shown in FIG. 1A exemplary of component connections within the expander tool.

Coupling of the pickup sub 102 to the first slip assembly 104 may utilize a connection arrangement, identified by area 3 and shown in an exploded view in FIG. 3, exemplary of similar recurring connections within the expander tool 400, as visible throughout FIGS. 1A to 1G. This connection arrangement facilitates building of the tool 400 without requiring making of connections to a torque that enables holding both tensile and rotational loads in operation. Further, the connection permits torque transmission across the tool 400 in either rotational direction, which may be possible with the work string 404 that is wrenched together during makeup of the work string 404.

Referring to FIG. 3, a nut 300 surrounding the pickup sub 102 includes external threads 301 that mate with internal threads 302 of a slip mandrel 116 of the slip assembly 104. Engagement between the threads 301, 302 takes tensile loads between the pickup sub 102 and the slip mandrel 116 by trapping a split ring 304 disposed in a groove 305 around the pickup sub 102 against a shoulder 306 along an inside of the slip mandrel 116. Castellated dogs 307 on an outer surface of the pickup sub 102 engage mating castellated dogs 308 around the inside of the slip mandrel 116. Rotational torque across the pickup sub 102 and the slip mandrel 116 received by the dogs 307, 308 thereby prevents imparting rotation to the threads 301, 302.

Figure 4:
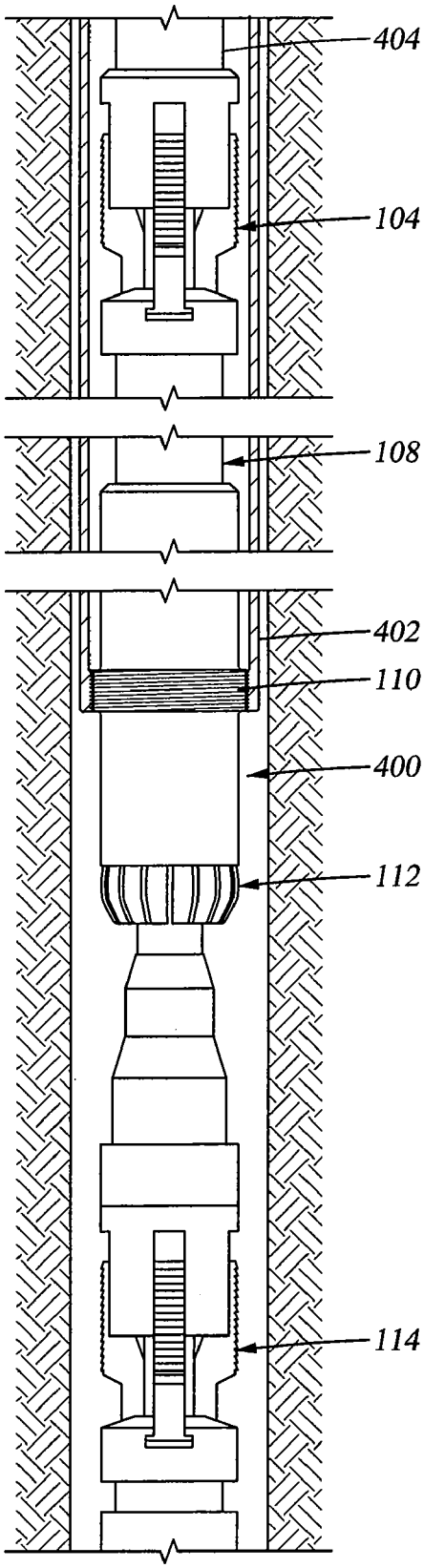
FIG. 4 is a schematic view of the expander tool disposed in tubing to be expanded and coupled to a work string.

With reference to FIGS. 1A and 4, the first slip assembly 104 includes a plurality of first wedges 118 with teeth 120 that may be oriented in one direction toward the swage 112. This orientation provides unidirectional gripping of a surrounding tubing 402 (shown in FIG. 4) to be expanded. To actuate the first slip assembly 104, fluid pressure supplied by the work string 404 to inside of the tool 400 passes through first slip port 122 in the slip mandrel 116 and acts on first slip piston 124 to move the first wedges 118 up a ramped portion of the slip mandrel 116. An actuated outer gripping diameter of the first slip assembly 104 corresponds to an inside diameter of the tubing 402 prior to expansion such that the teeth 120 engage the inside surface of the tubing 402. In operation, the tubing 402 may slide past the first slip assembly 104 toward the swage 112 to accommodate shrinkage of the tubing 402 during expansion, but is restrained by the first slip assembly 104 against moving with the swage 112. In the absence of actuating fluid pressure in the tool 400, first slip spring 126 returns the first slip assembly 104 to a deactivated position, as shown.

In some embodiments, a tell tail assembly may be included. For example, referring to FIG. 1B, the tell tail assembly 106 includes a sliding sleeve 128 acted on by a closing spring 130 and defining a pressure relief port 132 that is misaligned with a pressure relief passage 134 to inside of the tool 400 when the sliding sleeve 128 is normally biased by the spring 130. Upon full stroke of the jacks 108 during operation of the tool 400, a head member 142 of the jacks 108 contacts the sleeve 128 and pushes the sleeve 128 against the bias of the spring 130 to align the pressure relief port 132 of the sliding sleeve 128 with the pressure relief passage 134 to inside of the tool 400. This subsequent relief in pressure signals to an operator that the jacks 108 have completed a full stroke in order for the operator to reset the jacks 108 and commence expansion.

The tool 400, as illustrated, includes release features described further herein that enable the operator to collapse the swage 112, e.g., in an emergency or stuck situation, thereby permitting withdrawal of the swage 112 through, for example, unexpanded portions of the tubing 402. These features may require applying overpressure to the tool 400 while the pressure relief port 132 of the sliding sleeve 128 and the pressure relief passage 134 are aligned. Therefore, a tell tail closing sleeve 136 disposed inside the tell tail assembly 106 operates to enable blocking the pressure relief passage 134 to the inside of the tool 400. A shear pin 140 maintains the closing sleeve 136 above the pressure relief passage 134 until a collapse ball is dropped onto a closing sleeve seat 138 of the closing sleeve 136 such that fluid pressure above the ball shears the pin 140 and forces the sleeve 136 to move to a position that blocks the pressure relief passage 134. Additional fluid pressure above the ball forces the ball through the seat 138 to enable pressurizing further sections of the tool 400.

The jacks 108 create relative movement between an inner string 158 and an outer housing 160. This relative movement strokes the swage 112 that is coupled for movement with the outer housing 160 through the tubing 402 since one or both of the slip assemblies 104, 114 fix the inner string 158 with respect to the tubing 402. A first jack input port 144 supplies fluid to one of the jacks 108 and creates at least part of a driving fluid pressure that urges the head member 142 of the outer housing 160 toward the tell tail assembly 106.

The jacks 108 may include multiple jacks (three shown) connected in series to increase operating force provided by the jacks 108 that stroke the swage 112 through the tubing 402. For some embodiments, one full stroke of the jacks 108 translates the swage 112 twelve feet, for example, such that the jacks 108 that are longitudinally connected must occupy a sufficient length of the tool 400 to produce this translation. While the jacks 108 thereby generate sufficient force and still have a diameter that remains smaller than the diameter of the borehole, connecting the jacks 108 in series may make the tool 400 too long for feasible transport and handling as one piece requiring final assembly at the well.

Figure 1C:
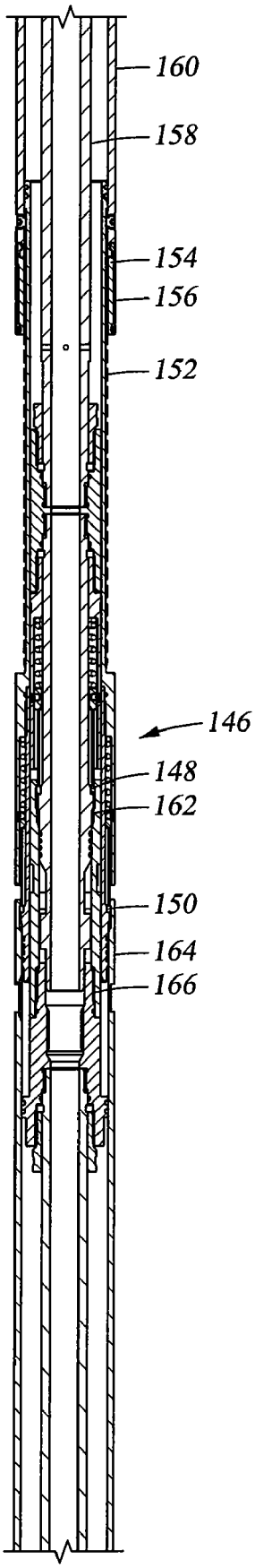

Therefore, FIG. 1C illustrates a first spear coupling arrangement 146 suitable for connecting the jacks 108 together at the rig floor using, for example, C-plates rather than a false rotary. For some embodiments, the spear coupling arrangement 146 may be connected downhole and/or be hydraulically operated. The first spear coupling arrangement 146 locks together longitudinal lengths of the inner string 158 of the jacks 108 and the outer housing 160 of the jacks 108 due to the engagements created by inner and outer collets 148, 150, respectively.

During stabbing of two sections of the jacks 108 together, a subsequent connecting inner portion 162 of the jacks 108 contacts the inner collets 148 and moves the inner collets 148 to an unsupported state against normal bias to a supported position. In addition, a subsequent connecting outer portion 164 of the jacks 108 contacts the outer collets 150 and moves the outer collets 150 to an unsupported state against normal bias to a supported position. The inner and outer collets 148, 150 then click into position and return back to respective supported positions, thereby securing the two sections of the jacks 108 together. A keyed engagement 166 enables transmission of torque through the inner string 158 at the first spear coupling arrangement 146.

The outer collets 150 may couple to an externally threaded placement holding sub 152 to facilitate moving the outer collets 150 relative to the inner collets 148. A segmented and internally threaded ring 154 mates by threaded engagement with the holding sub 152, while a cover 156 holds the threaded ring 154 together around the holding sub 152. Rotation of the threaded ring 154 relative to the holding sub 152 translates the holding sub 152 and hence the outer collets 150 axially. In a retracted position of the holding sub 152, the inner collets 148 may lock first during assembly followed by locking of the outer collets 150 upon extending the holding sub 152 to an extended position, as shown. This sequential locking feature therefore facilitates makeup and disassembly of the jacks 108 in a sealed manner.

Figure 1D:
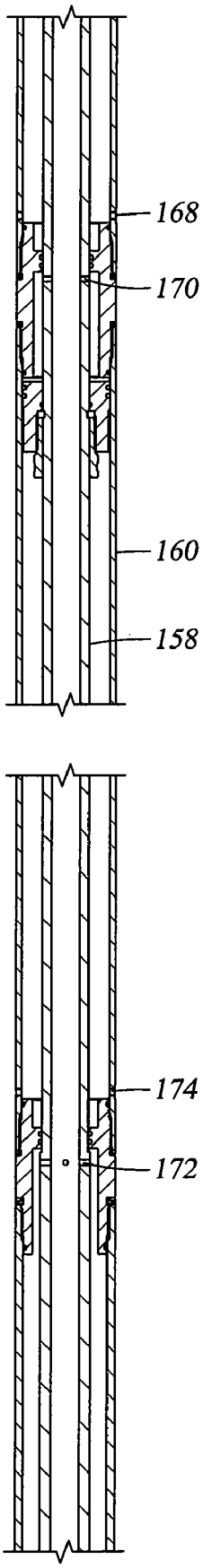

Referring to FIG. 1D, a first exhaust port 168 of the jacks 108 functions to relieve pressure to outside of the tool 400 so as to not oppose the movement in response to fluid pressure supplied through the first jack input port 144. Second and third jack input ports 170, 172 supply fluid to additional ones of the jacks 108 to boost the force that moves the outer housing 160 relative to the inner string 158. Second and third exhaust ports 174, 176 (shown in FIG. 1F) disposed on opposite operational piston sides relative to the second and third jack input ports 170, 172, respectively, ensure that this movement occurs unopposed.

Figure 1E:
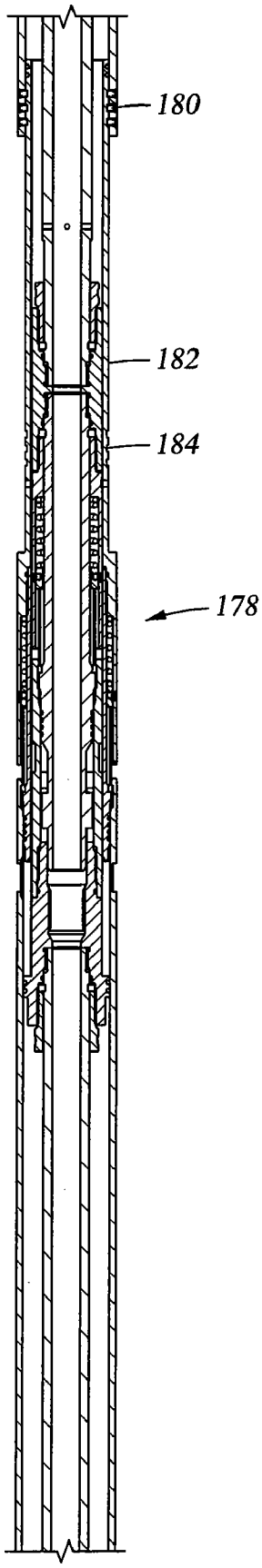

With reference to FIG. 1E, a second spear coupling arrangement 178 may connect further sections of the jacks 108 together. The first and second spear coupling arrangements 146, 178 may be identical such that there may not be any differences between FIGS. 1C and 1E for some embodiments. However, an alternative configuration exemplarily depicted by way of the second spear coupling arrangement 178 shows an externally circular grooved placement holding sub 182 instead of the externally threaded placement holding sub 152 in the first spear coupling arrangement 146. While both placement holding subs 152, 182 are movable for the same purpose between extended and retracted positions, axial movement of the grooved placement holding sub 182 occurs by manual axial manipulation, which may be facilitated by engagement of the grooved placement holding sub 182 with a C-plate. To maintain the grooved placement holding sub 182 in either the extended or retracted position, threaded pins engage axially spaced sets of circular grooves 184 corresponding to each position. In operation, the operator backs the pins 180 out to a lock-ring stop (not visible) and then positions the grooved placement holding sub 182 in either the extended position or retracted position prior to advancing the pins 180 back into corresponding ones of the grooves 184 to hold the grooved placement holding sub 182 axially. The second spear coupling arrangement 178 otherwise operates and functions like the first spear coupling arrangement 146 described herein.

Figure 1F:
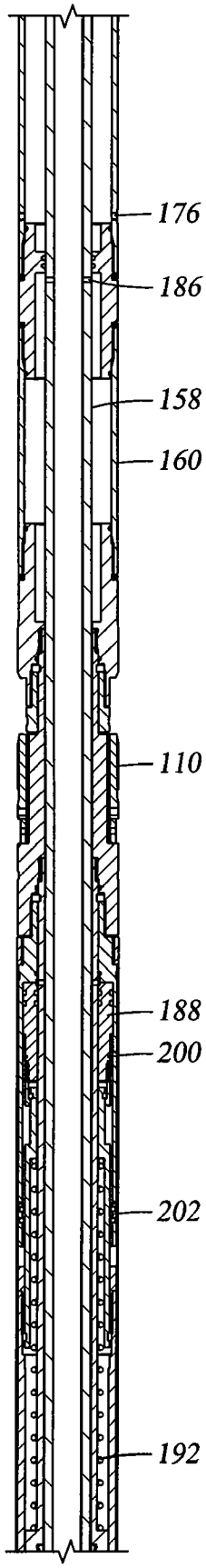

Referring to FIG. 1F, the externally threaded, tool-to-unexpanded tubing, coupler sub 110 couples to the outer housing 160 to move relative to the inner string 158 upon actuation of the jacks 108. For some embodiments, the coupler sub 110 may be omitted, such as when the tubing 402 is already disposed in the borehole prior to lowering the tool 400. Further, the coupler sub 110 may employ, in some embodiments, various other types of connections than threads. Threaded engagement between the coupler sub 110 and an end of the tubing 402 supports the tool 400 within the tubing 402 during makeup of the tubing 402 and/or suspends the tubing 402 around the tool 402 while deploying the work string 404 into the borehole. A relative hard material with respect to the tubing 402 may form the coupler sub 110 such that the coupler sub 110 expands/deforms the tubing 402 at the threaded engagement to release the tubing 402 from the coupler sub 110 upon initiating the expansion process with the jacks 108 after gripping the tubing 402 with the first slip assembly 104.

Figure 1G:
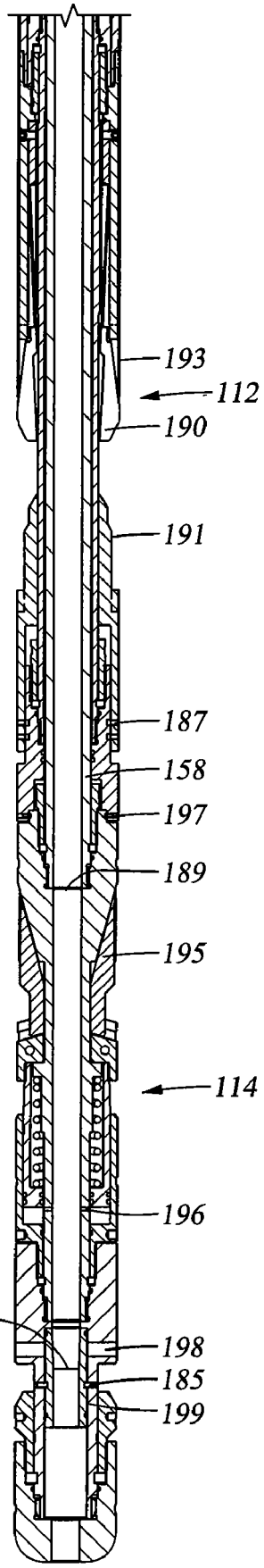

Aspects shown related to the swage 112 and actuation of the swage 112 extend across FIGS. 1F and 1G and include a swage piston 188 coupled to swage collets 190, which ride up and are propped up by extended collets support surface 191. In operation, a swage input port 186 directs pressurized fluid inside the inner string 158 to the swage piston 188 coupled to the swage 112. The pressurized fluid overcomes urging of an expander tool spring 192 maintaining the swage collets 190 in a retracted position. A swage shroud 193 may cover at least part of the swage collets 190 while in the retracted position and aid in holding the swage collets 190 in a radial inward direction.

The end of the tool shown in FIG. 1G further includes the second slip assembly 114 and a tool bore closing element such as a ball seat 194 for sealing off the interior of the inner string 158 once an actuation ball (not shown) is dropped and landed in the seat 194. The second slip assembly 114 includes a plurality of second wedges 195 urged toward a deactivated position in the absence of an actuating fluid pressure supplied through the second slip port 196. An actuated outer gripping diameter of the second slip assembly 114 corresponds to an inside diameter of the tubing 402 after expansion such that the second wedges 195 grip the inside surface of the tubing 402 at locations along the tubing 402 where the swage 112 has already been stroked through the tubing 402.

In operation, the ball seat 190 receives the actuation ball having a smaller diameter than the closing sleeve seat 138 such that the actuation ball passes straight through the tell tail closing sleeve 136. Closing off flow through the tool 400 enables fluid flowing through the work string 404 to pressurize the tool 400 including the first slip port 122, the jack ports 144, 170, 172, the swage input port 186, and the second slip port 196. The slip assemblies 104, 114 activate with the swage 112 prior to the jacks 108 initiating relative movement between the inner string 158 and the outer housing 160 due to jacking delay shear pin 197 that temporarily prevents this relative movement until an identified fluid pressure is reached above the pressure required to extend the swage 112.

Figure 2:
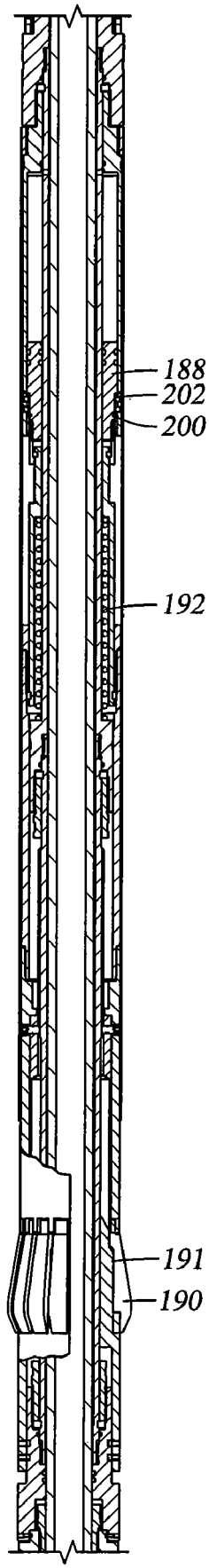
FIG. 2 is a partial cross-section view of a portion of the expander tool after actuation of a collapsible swage held by a latch section shown enlarged in FIG. 2A.
Figure 2A:
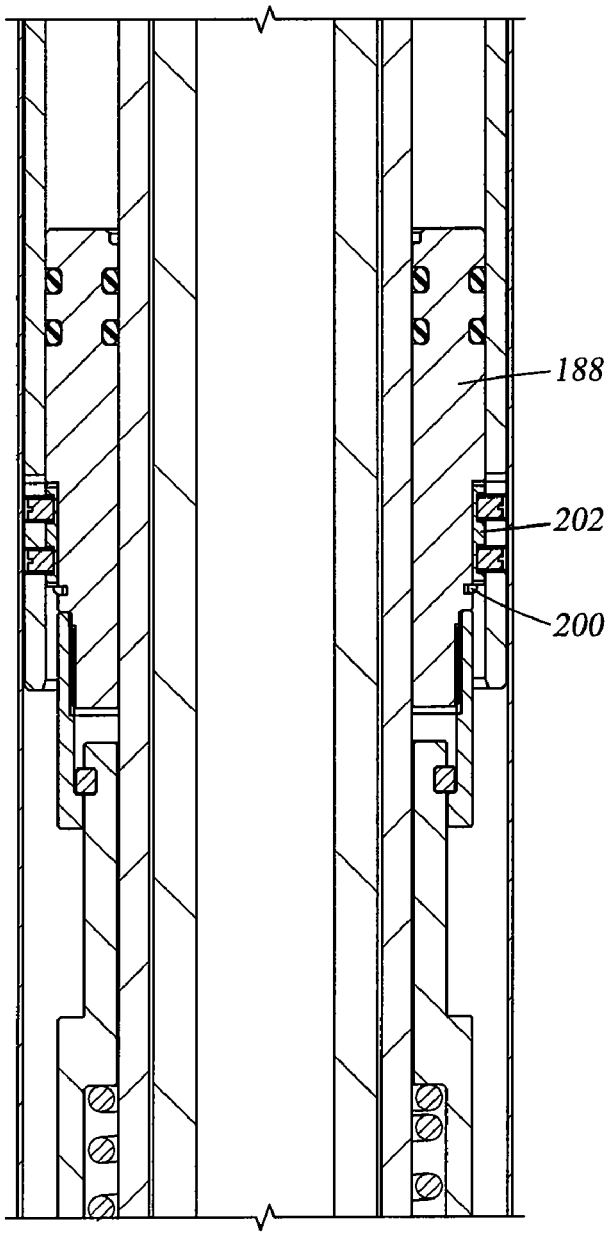

FIG. 2 shows a portion of the expander tool 400 after actuation of the collapsible swage 112. During actuation, fluid pressure forces the piston 188 to move against the bias of the expander tool spring 192 thereby positioning the collets 190 against the extended collets support surface 191. A latching configuration may retain the swage 112 in the extended position with the spring 192 compressed even after relieving fluid pressure applied to the piston 188. For some embodiments, a snap ring 200 (see the enlarged view in FIG. 2A) disposed around an outside of the piston 188 and an inward protruding shear pinned ring 202 temporarily pinned at a fixed position along a traveling path of the piston 188 define this latching configuration. A sloped leading edge of the snap ring 200 enables the snap ring 200 to pass across the shear pinned ring 202 during actuation of the swage 112 while a retaining back edge of the snap ring 200 engages the shear pinned ring 202 and prevents the spring 192 from urging the piston 188 back.

As illustrated in FIGS. 1G and 2, the release features for the swage 112 provide the ability to release the swage 112 from the extended position thereby causing the spring 192 to act on the piston 188 and pull back in the collets 190, such as depicted in FIG. 1G. While the swage 112 may collapse to have an outer diameter smaller than an inner diameter of the tubing 402 prior to expansion of the tubing 402, the outer diameter of the swage 112 when collapsed may, for some embodiments, remain larger than the inner diameter of the tubing 402 prior to expansion of the tubing 402. Applying an identified overpressure to the tool 400 provides sufficient force via the piston 188 and the collets 190 coupled to the piston 188 to cause an outward facing shoulder of the piston 188 to bears on the shear pinned ring 202 until broken free or released to permit movement of the ring 202 with the piston 188. As a result of the shear pinned ring 202 being released and making the snap ring 200 thus unfixed, the spring 192 may function to retract the swage 112 once pressure is relieved from the tool 400.

The overpressure may further subsequently shift an overpressure sleeve 199 that provides the ball seat 194. Drain opening shear pins 185 hold the overpressure sleeve 199 blocking an overpressure drain 198 during normal operation of the tool 400. After the overpressure causes retraction of the swage 112, the shear pins 185 fail permitting the overpressure sleeve 199 to move and open the overpressure drain 198 such that a wet string does not have to be pulled out of the well since fluid exits from the tool 400 and the work string 404 through the overpressure drain 198.

A relatively larger redundant ball seat 189, disposed above the overpressure drain 198 may be utilized should the overpressure sleeve 199 shift prior to retraction of the swage 112. The redundant ball seat 189 therefore enables an even greater overpressure to be applied for causing hydraulic based retraction of the swage 112 as described heretofore. A third redundant option for retracting the swage 112, if stuck, involves mechanical pulling of the tool 400 using forces (e.g., 90,700 kilograms) exceeding those required for expanding the tubing 402. This pulling of the inner string 158 while the swage 112 is stuck causes the swage release shear pins 187 to fail and hence loading beyond holding capacity of the shear pinned ring 202 resulting in release of the piston 188, as occurs with the hydraulic based retraction options. The spring 192 may then function to retract the swage 112.

FIG. 4 illustrates the expander tool 400 disposed in the tubing 402 to be expanded and coupled to the work string 404. The externally threaded, tool-to-unexpanded tubing, coupler sub 110 of the tool 400 supports the tubing 402 around the tool 400 by mating threaded engagement at the end of the tubing 402. The run-in configuration as shown in FIG. 4 includes the slips 104, 114, the swage 112, and the jacks 108 all as initially assembled prior to pressurizing the tool 400.

Figure 5:
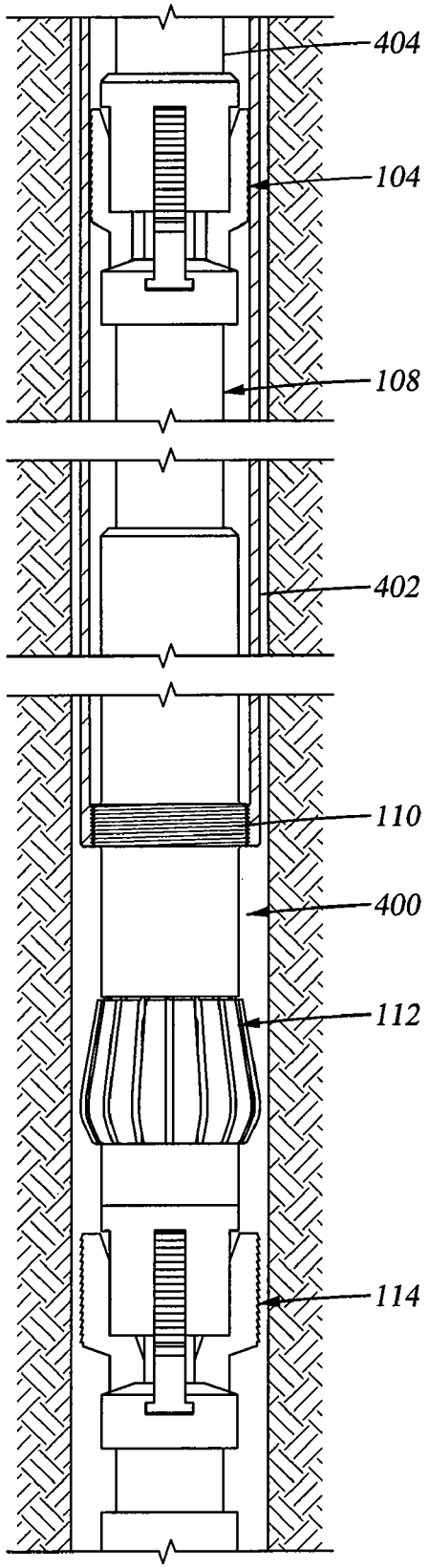
FIG. 5 is a schematic view of the expander tool disposed in the tubing with the collapsible swage and first and second slips actuated such that the first slips grip the tubing.

FIG. 5 shows the expander tool 400 disposed in the tubing 402 with the collapsible swage 112 and first and second slip assemblies 104, 114 actuated such that the first slip assembly 104 grips the tubing 402. As described herein, dropping the actuation ball and supplying fluid through the work string 404 may achieve pressurization of the tool 400 for this actuation. The second slip assembly 114, while actuated, may fail to grip or extend into engaging contact with any surrounding surfaces, such as an open borehole wall.

Figure 6:
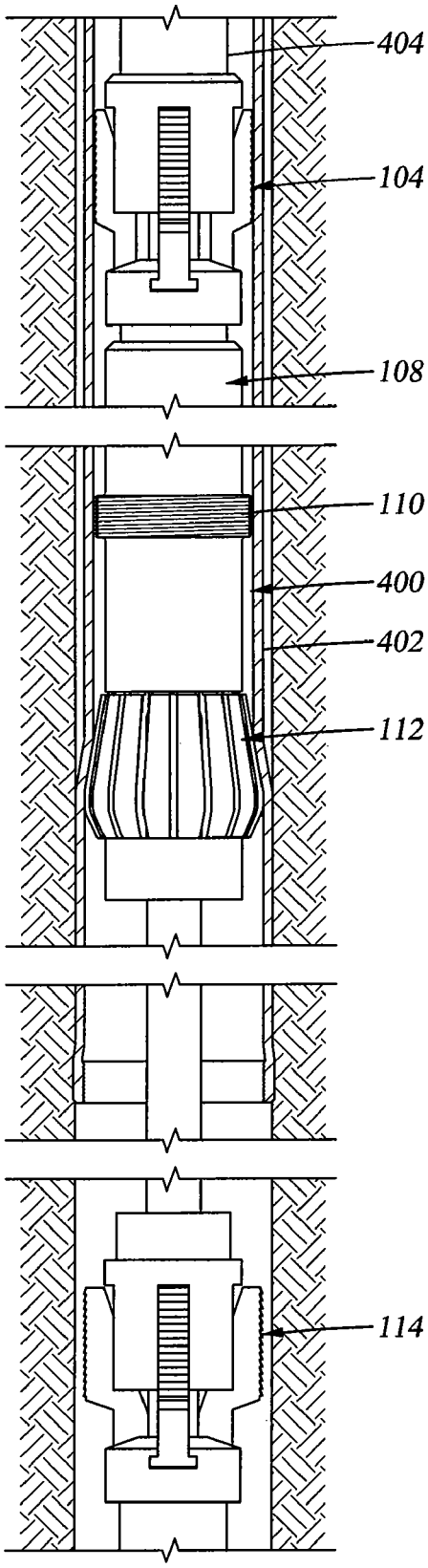
FIG. 6 is a schematic view of the expander tool upon actuation of a hydraulic jack to stroke the swage through the tubing toward the first slips.

FIG. 6 illustrates the expander tool 400 upon actuation of the jacks 108 to stroke the swage 112 through the tubing 402 toward the first slip assembly 104. The coupler sub 110 of the tool 400 disengages from the tubing 402 at the beginning of the initial stroke of the jacks 108 by, for example, initiating expansion of the tubing 402 at least at the engagement of the tubing 402 with the coupler sub 110. The swage 112 may expand a circumference of the tubing 402 as the swage 112 passes through the tubing 402. At the end of the stroke of the jacks 108, the operator releases pressure in the tool 400 to deactivate the first slips 104, which may be locked out from reactivation in some embodiments. The swage 112 stays positioned in the tubing 402 where expansion stopped since the swage 112 remains latched in the extended position even without the tool 400 being pressurized. Next, the operator pulls on the work string 404 to reset the jacks 108 and position the second set of slips 114 in the tubing 402.

Figure 7:
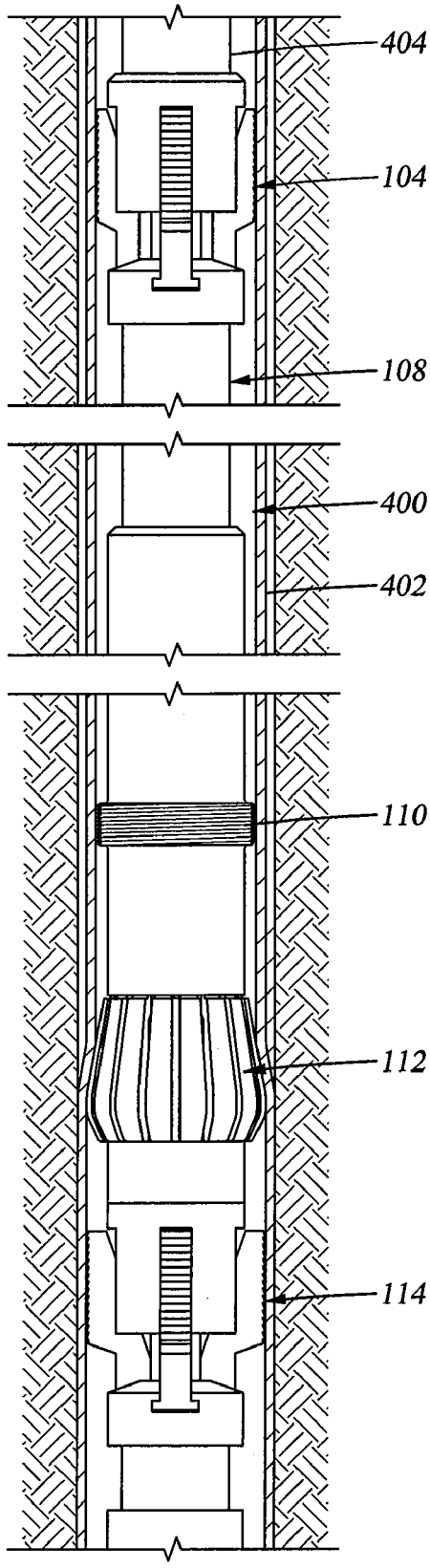
FIG. 7 is a schematic view of the expander tool after resetting the jack and reactivating the slips such that the second slips grip the tubing in order to expand more or all of the tubing via this cycling of the tool.

As shown in FIG. 7, pressurization of the tool 400 activates the second slip assembly 114 to grip the tubing 402 at a location that the swage 112 previously expanded. The pressurization also operates the jacks 108 to move the swage 112 through the tubing 402. Cycling of the tool 400 by resetting the jacks 108 after every pressurization of the tool 400 to reset the second slip assembly 114 and stroke the jacks 108 enables expanding more or all of the tubing 402.

Figure 8:
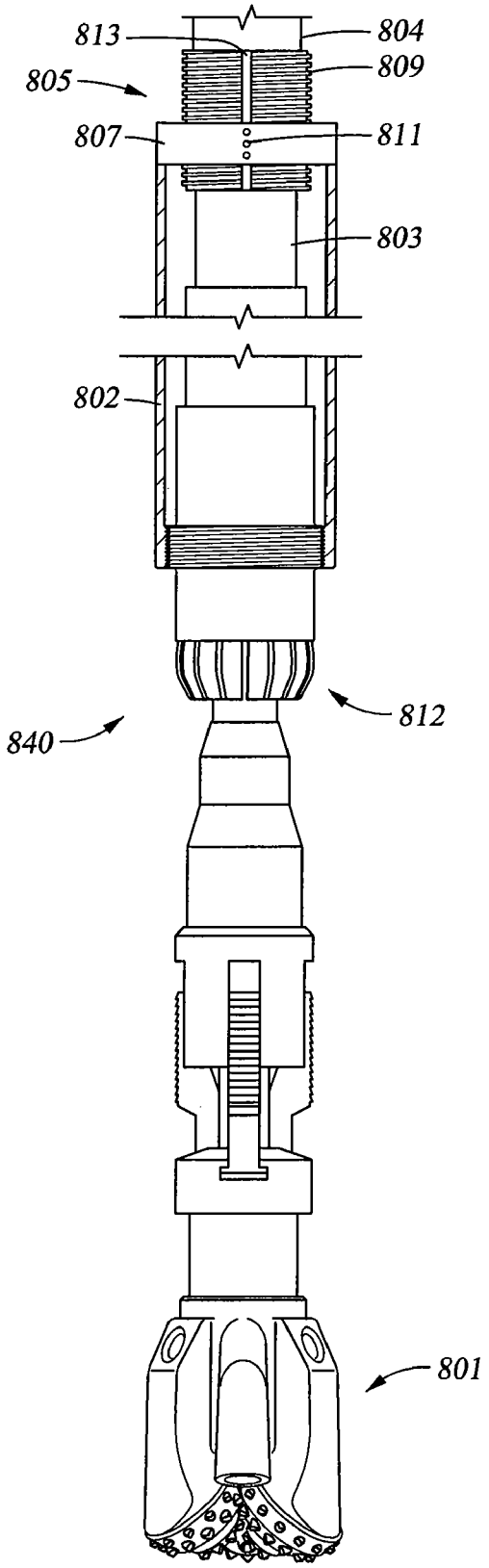
FIG. 8 is a schematic view of an assembly with an optional drillbit/underreamer coupled to an expander device similar to the tool shown in FIGS. 1A to 1G with the first slips replaced with a liner stop holding down a surrounding tubing to be expanded.

FIG. 8 illustrates an assembly 800 with an optional drillbit/underreamer 801 coupled to an expander device 840 similar to the tool 400 shown in FIGS. 1A to 1G. Any embodiment described herein may incorporate earth removal members such as the drillbit/underreamer 801 to permit one trip drilling/underreaming and locating and expanding tubing. While not shown, such drilling assemblies may further include, for example, a mud motor, a logging while drilling (LWD) device, a measurement-while-drilling (MWD) device, and/or a rotary steerable system. Furthermore, the drilling assemblies may be deployed on conveyance members such as drill pipe or coiled tubing. Ability to transmit torque across the tool 800 facilitates these one trip operations.

The method of one trip drilling/underreaming and locating and expanding tubing may involve rotating and axially moving a work string 804 to advance the drillbit/underreamer 801 through a formation, such as below a previously cased portion of a well. The drillbit/underreamer 801 may form separate tools or one integrated component that drills identified diameter boreholes. For example, drilling may form a borehole of a first diameter. Underreaming of the borehole may create a section with a second diameter larger than the first diameter and in which a surrounding tubing 802 is to be expanded to have, for example, an inner diameter substantially matching the first diameter of the borehole. Positioning of the tubing 802 at the section with the second diameter and then expanding the tubing 802 based on the description herein may occur after the drilling and/or underreaming. Previously incorporated U.S. Provisional Patent Application No. 60/829,374, describes such methods that enable forming a monobore well.

Instead of the first slip assembly 104 shown in FIG. 4, a liner stop 805 holds down the tubing 802 to be expanded during an initial stroke of a swage 812 through the tubing 802. Like the drillbit/underreamer 801 that may be utilized with any embodiment described, the liner stop 805 may replace the first slips of any embodiment herein whenever practical depending on the length of the tubing 802. A filler pipe 803 spans from an end of the device 840 to an end of the tubing 802 opposite the swage 812. The liner stop 805 couples between the work string 804 and the filler pipe 803.

For some embodiments, an internally threaded interference ring 807 of the liner stop 805 threads around an externally threaded locking sub 809 of the liner stop 805. In operation, the interference ring 807 is rotated with respect to the locking sub 809 to translate the interference ring 807 into abutting contact with the end of the tubing 802 once the device 840 is coupled to the tubing 802. Pins 811 inserted through walls of the interference ring 807 and into corresponding external longitudinal slots 813 along the locking sub 809 may prevent further relative rotation between the interference ring 807 and the locking sub 809 and maintain the interference ring 807 in contact with the tubing 802 at least until expansion initiates at which time the tubing 802 is prevented from moving away from or with the swage 812 but may shrink and move away from the interference ring 807. Otherwise, and after the first stroke, the device 840 may operate and function like the tool 400 described herein.

Figure 9:
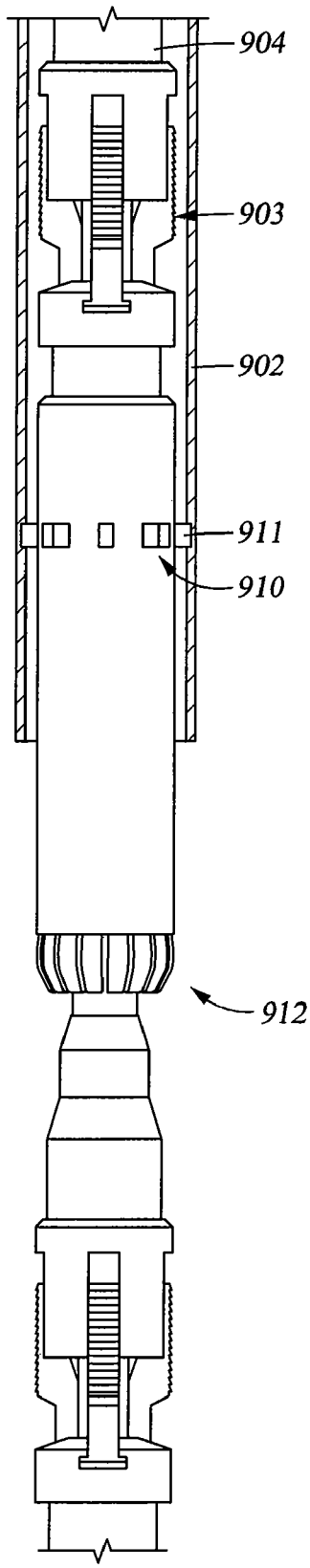
FIG. 9 is a schematic view of another expander device also similar to the tool shown in FIGS. 1A to 1G but incorporating a latching mechanism to couple the device to tubing to be expanded instead of a threaded relationship.

FIG. 9 shows another expander device 940 also similar to the tool 400 shown in FIGS. 1A to 1G but incorporating a latching mechanism 910 to couple the device to tubing 902 to be expanded instead of a threaded relationship. The latching mechanism 910 permits the device 940 to be run through the tubing 902 while the tubing 902 is disposed in the borehole, e.g., while suspended from the well surface, and latched into the tubing 902. Once latched into the tubing 902, the tubing 902 may be released from being suspended and run-in the borehole with the device 940 to an identified location using the work string 904. For some embodiments, the latching mechanism 910 includes dogs 911 that are frangible upon actuation of the device 940 as described herein. The dogs 911 may retract in some embodiments upon actuation of a first slip assembly 903 and swage 912. Patent application publication U.S. 2004/0216892 A1, which is herein incorporated by reference, discloses an exemplary suitable latch for use as the latching mechanism 910.

As exemplarily depicted in the illustrations and their orientation, expanding of the tubing progresses from a bottom of the tubing to its top. However, tubing expansion according to the invention may take place either bottom-up or top-down depending on application and configuration of the tool. In addition, a solid expander (e.g., a fixed diameter cone) or any compliant or collapsible swage may replace segmented, collet-type swages identified in the preceding description and shown by way of example in the figures.

Figure 10:
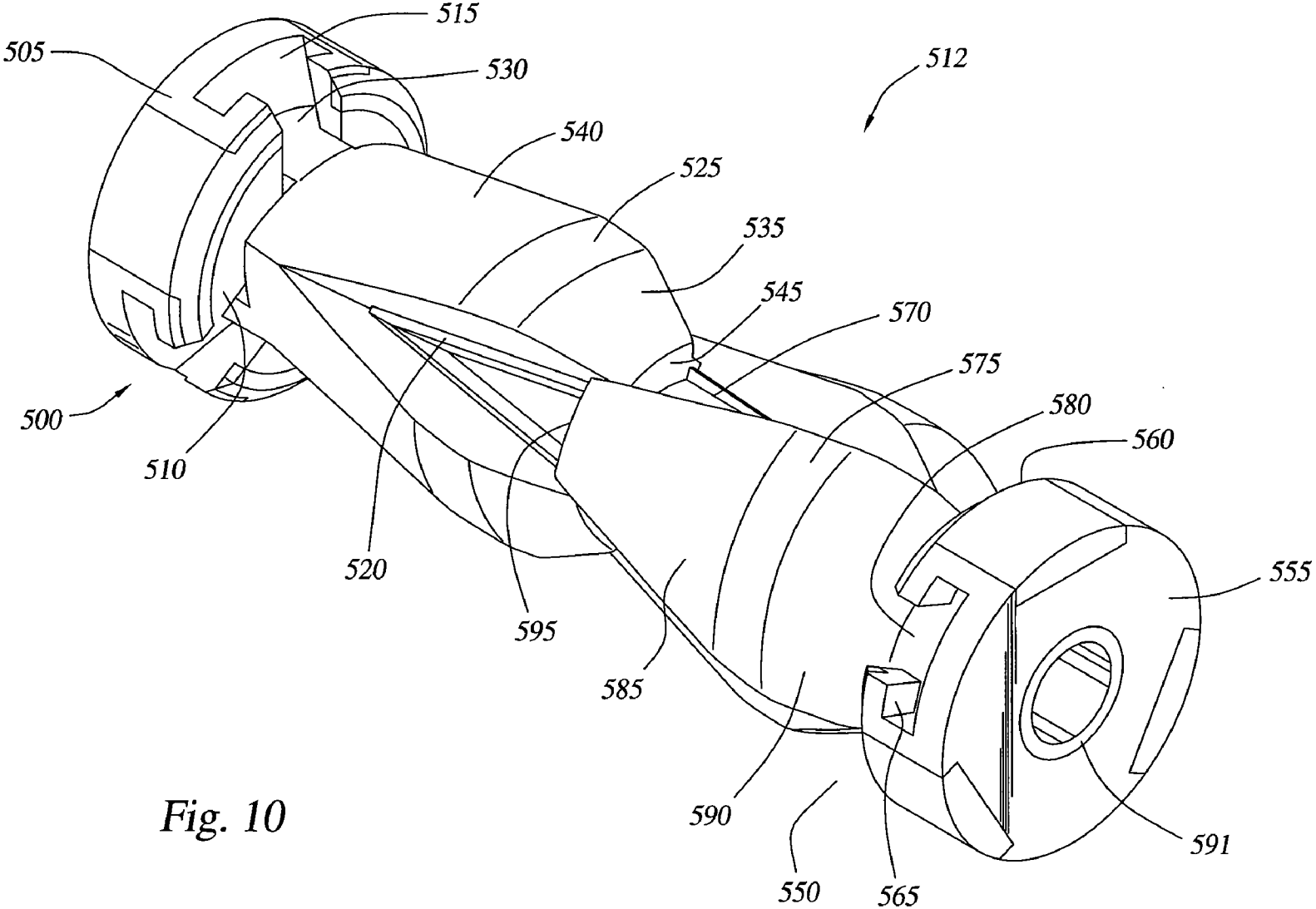
FIGS. 10 and 11 illustrate an alternative swage for the expander tool, according to embodiments of the invention.

In one embodiment, the swage piston 188, for example and with reference to FIG. 1F, may operatively couple to a two-position expander 512 that is shown in FIG. 10 prior to radially extending cone segments 525, 575. As such, the two-position expander 512 illustrates another type of the swage 112 for use in the expander tool 400 depicted in FIG. 4. U.S. Pat. No. 7,121,351, which is incorporated herein in its entirety, describes the two-position expander 512 and its operation.

Generally, the two-position expander 512 comprises a first assembly 500 and a second assembly 550. The first assembly 500 includes a first end plate 505 and the plurality of cone segments 525. The first end plate 505 is a substantially round member with a plurality of "T"-shaped grooves 515 formed therein. Each groove 515 matches a "T"-shaped profile 530 formed at an end of each cone segment 525. It should be understood, however, that the groove 515 and the profile 530 are not limited to the "T"-shaped arrangement illustrated in FIG. 10 but may be formed in any shape without departing from principles of the present invention.

Each cone segment 525 has an outer surface that includes a first taper 540 adjacent to the shaped profile 530. As shown, the first taper 540 has a gradual slope to form the leading shaped profile of the two-position expander 512. Each cone segment 525 further includes a second taper 535 adjacent to the first taper 540. The second taper 535 has a relatively steep slope to form the trailing profile of the two-position expander 512. The inner surface of each cone segment 525 preferably has a substantially semi-circular shape to allow the cone segment 525 to slide along an outer surface of a tubular member 591 (e.g., similar to the support surface 191 visible in FIG. 1G). Furthermore, a track portion 520 is formed on each cone segment 525. The track portion 520 is used with a mating track portion 570 formed on each cone segment 575 to align and interconnect the cone segments 525, 575. In this embodiment, the track portion 520 and mating track portion 570 arrangement is similar to a tongue and groove arrangement. However, any track arrangement may be employed without departing from principles of the present invention.

Similar to the first assembly 500, the second assembly 550 of the two-position expander 512 includes a second end plate 555 and the plurality of cone segments 575. The end plate 555 is preferably a substantially round member with a plurality of "T"-shaped grooves 565 formed therein. Each groove 565 matches a "T"-shaped profile 580 formed at an end of each cone segment 575.

Each cone segment 575 has an outer surface that includes a first taper 590 adjacent to the shaped profile 580. As shown, the first taper 590 has a relatively steep slope to form the trailing shaped profile of the two-position expander 512. Each cone segment 575 further includes a second taper 585 adjacent to the first taper 590. The second taper 585 has a relatively gradual slope to form the leading profile of the two-position expander 512. The inner surface of each cone segment 575 preferably has a substantially semi-circular shape to allow the cone segment 575 to slide along an outer surface of the tubular member 591.

Figure 11:
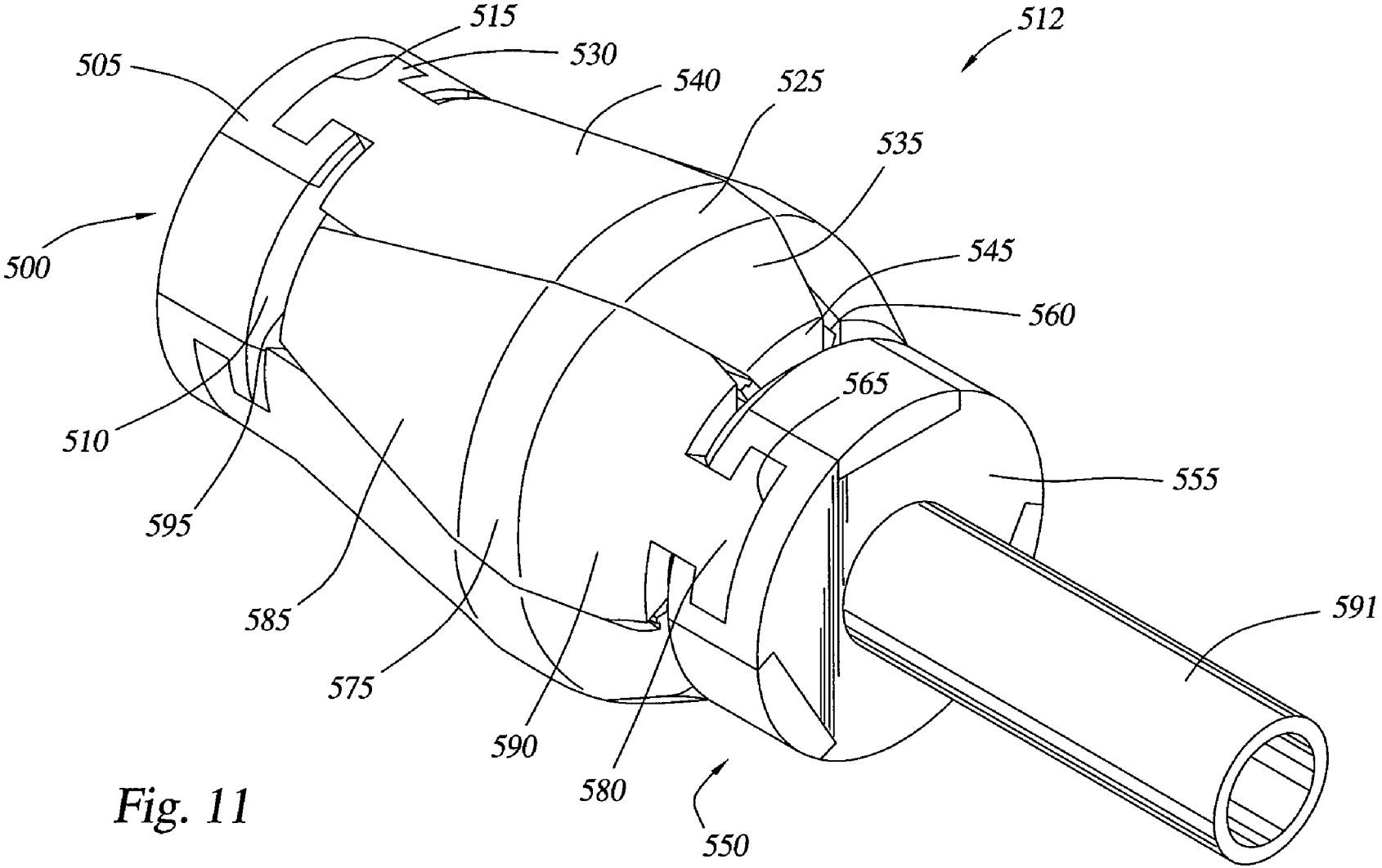

FIG. 11 is an enlarged view of the two-position expander 512 after radially extending the cone segments 525, 575. The first assembly 500 and the second assembly 550 are urged linearly toward each other along the tubular member 591. As the first assembly 500 and the second assembly 550 approach each other, the cone segments 525, 575 are urged radially outward. More specifically, as the cone segments 525, 575 travel linearly along the track portion 520 and mating track portion 570, a front end 595 of each cone segment 575 wedges the cone segments 525 apart, thereby causing the shaped profile 530 to travel radially outward along the shaped groove 515 of the first end plate 505. Simultaneously, a front end 545 of each cone segment 525 wedges the cone segments 575 apart, thereby causing the shaped profile 580 to travel radially outward along the shaped groove 565 of the second end plate 555. The radial and linear movement of the cone segments 525, 575 continue until each front end 545, 595 contacts a stop surface 510, 560 on each end plate 505, 555 respectively. In this manner, the two-position expander 512 is moved from the first position having a first diameter to the second position having a second diameter that is larger than the first diameter.

Although the expander 512 illustrated in FIGS. 10 and 11 is a two-position expander, the expander 512 may be a multi-position expander having any number of positions without departing from principles of the present invention. For instance, the cone segments 525, 575 could move along the track portion 520 and mating track portion 570 from the first position having a first diameter to the second position having a second diameter and subsequently to a third position having a third diameter that is larger than the first and second diameters.

While the foregoing is directed to embodiments of the present invention, other and further embodiments of the invention may be devised without departing from the basic scope thereof, and the scope thereof is determined by the claims that follow.

What is claimed is:

1. A system for expanding tubing in a wellbore, comprising:

an expander disposed on a work string and having a first extended configuration capable of expanding the tubing and a second collapsed configuration with a smaller outer diameter than the first extended configuration;

first and second tubing holding devices disposed on the work string and located respectively ahead of the expander and behind the expander, wherein the expander is movable relative to each of the first and second tubing holding devices while the second tubing holding device is non-releasably coupled to the work string during operation downhole, and wherein at least a portion of the expander and the second tubing holding device are initially disposed below the tubing as the system is run into the wellbore; and a hydraulic operated jack coupled to the expander and configured to move the expander relative to each of the first and second tubing holding devices.

2. The system of claim 1, wherein the first and second tubing holding devices are fluid pressure actuated.

3. The system of claim 1, wherein the expander is actuated between configurations by fluid pressure.

4. The system of claim 3, further comprising a latch to retain the expander in the first extended configuration in the absence of fluid pressure supplied to the expander.

5. The system of claim 4, wherein the latch is releasable to permit free movement of the expander between configurations.

6. The system of claim 1, wherein the jack comprises a series of jacks coupled together with a spear connection that includes mating ends locked together by collets.

7. The system of claim 1, wherein the jack comprises a series of jacks coupled together with a spear connection that includes concentric inner and outer string mating ends locked together by respective collets.

8. The system of claim 1, wherein the jack, the first and second tubing holding devices and the expander are all coupled together by connections having mating torque transmitting formations and a threaded engagement.

9. The system of claim 1, further comprising a releasable connection for temporarily coupling the work string and the tubing.

10. The system of claim 9, wherein the releasable connection includes a threaded sub disposed between the expander and the first tubing holding device.

11. The system of claim 1, wherein the first and second tubing holding devices are slip assemblies sized to grip an inside surface of the tubing.

12. The system of claim 1, wherein the first tubing holding device is a slip assembly with unidirectional teeth that are angled toward the expander and grip an inside surface of the tubing.

13. The system of claim 1, wherein the first tubing holding device comprises a stop member abutting an end of the tubing.

14. The system of claim 1, wherein the expander is actuatable prior to actuation of the jack.

15. The system of claim 1, wherein at least one of the first and second tubing holding devices is re-settable downhole.

16. The system of claim 1, wherein the first tubing holding device is operable to accommodate axial length changes of the tubing as the expander is moved through the tubing to expand the tubing.

17. The system of claim 1, wherein the first tubing holding device is operable to facilitate movement of the expander relative to the tubing during expansion of an initial portion of the tubing.

18. The system of claim 17, wherein the second tubing holding device is operable to facilitate movement of the expander relative to the tubing during expansion of a subsequent portion of the tubing after expansion of the initial portion.

19. The system of claim 1, further comprising a boring tool disposed on an end of the workstring.

20. The system of claim 1, wherein the second tubing holding device is initially disposed below the tubing prior to expansion of the tubing.

21. The system of claim 1, wherein the second tubing holding device is configured to grip the tubing during expansion of the tubing while the first tubing holding device is deactivated from engagement with the tubing.

22. The system of claim 1, wherein the second tubing holding device is stationarily coupled to the work string below the tubing while the expander moves relative to the second tubing holding device.

23. The system of claim 1, wherein the second tubing holding device is affixed to the work string and is movable relative to at least one of the first tubing holding device and the expander using the work string.

24. The system of claim 1, wherein the work string is operable to reset the hydraulically operated jack downhole and operable to move the second anchor to a previously expanded location within the tubing to cycle the system through the tubular.

25. The system of claim 24, wherein the second anchor is movable relative to the expander when being moved by the work string to the previously expanded location.

26. A system for expanding tubing in a wellbore, comprising:

an expandable tubular releasably coupled to a work string;

a selectively actuatable expansion member coupled to the work string and located below the tubular prior to expansion of the tubular;

a first anchor and a second anchor each coupled to the work string, wherein the first anchor is located within the tubular and the second anchor is located below the tubular prior to expansion of the tubular, wherein the expansion member is movable relative to each of the first and second anchors while the second anchor is non-releasably coupled to the work string during operation downhole, and wherein at least a portion of the expansion member and the second anchor are initially disposed below the tubular as the system is run into the wellbore.

27. The system of claim 26, further comprising one or more jacks configured to move the expansion member relative to at least one of the first and second anchors to expand the tubular.

28. The system of claim 26, wherein the expansion member is selectively actuatable between a first position having an outer diameter greater than the inner diameter of the tubular and a second position having an outer diameter less than the inner diameter of the tubular.

29. The system of claim 26, wherein at least one of the first and second anchors is resettable in the wellbore.

30. The system of claim 26, wherein the second anchor is configured to grip the tubular during expansion of the tubular while the first anchor is deactivated from engagement with the tubular.

31. The system of claim 26, wherein the second anchor is stationarily coupled to the work string below the tubular while the expansion member moves relative to the second anchor.

32. The system of claim 26, wherein the second anchor is affixed to the work string and is movable relative to at least one of the first anchor and the expansion member using the work string.

33. The system of claim 26, wherein the work string is operable to reset a jack configured to move the expansion member through the tubular and operable to move the second anchor to a previously expanded location within the tubular to cycle the system through the tubular.

34. The system of claim 33, wherein the second anchor is movable relative to the expansion member when being moved by the work string to the previously expanded location.

35. A system for expanding tubing in a wellbore, comprising:

an expander disposed on a work string and having a first extended configuration capable of expanding the tubing and a second collapsed configuration with a smaller outer diameter than the first extended configuration;

first and second tubing holding devices coupled to the work string and located respectively ahead of the expander and behind the expander, wherein at least a portion of the expander and the second tubing holding device are initially disposed below the tubing as the system is run into the wellbore, and wherein the second tubing holding device remains coupled to the work string below the tubing while the expander moves relative to the second tubing holding device; and a jack coupled to the expander and configured to move the expander relative to each of the first and second tubing holding devices.

* * * * *